US012631131B2

(12) United States Patent
Kim et al.

(10) Patent No.: US 12,631,131 B2
(45) Date of Patent: May 19, 2026

(54) ONCE-THROUGH HEAT EXCHANGER AND HEAT RECOVERY STEAM GENERATOR INCLUDING THE SAME

(71) Applicant: DOOSAN ENERBILITY CO., LTD., Changwon (KR)

(72) Inventors: Kyu Man Kim, Busan (KR); Uk Kim, Changwon (KR); Jae Cheol Kim, Busan (KR); Min Su Kim, Gimhae (KR); Jung Ah Son, Changwon (KR); Young Wook Lee, Changwon (KR); Jong Ho Hong, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 214 days.

(21) Appl. No.: 18/451,143

(22) Filed: Aug. 17, 2023

(65) Prior Publication Data

US 2024/0159172 A1 May 16, 2024

(30) Foreign Application Priority Data

Nov. 14, 2022 (KR) ..... 10-2022-0151966

(51) Int. Cl.

| | |
|---|---|
| ***F01K 23/10*** | (2006.01) |
| ***F22B 21/00*** | (2006.01) |
| ***F28F 9/02*** | (2006.01) |

(52) U.S. Cl.

CPC ..... *F01K 23/10* (2013.01); *F22B 21/00* (2013.01); *F28F 9/0246* (2013.01); *F28F 2265/26* (2013.01)

(58) Field of Classification Search

CPC ..... F01K 23/10; F01K 11/02; F28D 21/001; F28D 1/047; F28D 2021/0026;

(Continued)

(56) References Cited

U.S. PATENT DOCUMENTS

| | | | |
|---|---|---|---|
| 4,473,035 | A | 9/1984 | Gorzegno |
| 4,832,119 | A | 5/1989 | Bloor |

(Continued)

FOREIGN PATENT DOCUMENTS

| | | | |
|---|---|---|---|
| CH | 573087 | A5 * | 2/1976 |
| CN | 573087 | A5 * | 2/1976 |

(Continued)

OTHER PUBLICATIONS

Pdf is translation of foreign reference JP-2007016791-A (Year: 2007).*

(Continued)

*Primary Examiner* — Len Tran
*Assistant Examiner* — Kamran Tavakoldavani
(74) *Attorney, Agent, or Firm* — Harvest IP Law, LLP

(57) ABSTRACT

Disclosed herein is a once-through heat exchanger that includes a tube stack including a plurality of tubes, a plurality of heads connected to the tube stack via a connection module and configured to accommodate heated steam, the connector module comprising a plurality of tube connectors and configured to connect the tubes and the heads, and a manifold connected to the heads via a plurality of link pipes and configured to accommodate heated steam, wherein the connector module comprises a first tube connector and a second tube connector having different shapes.

10 Claims, 7 Drawing Sheets

(58) Field of Classification Search
CPC ..... F28D 2021/0064; F28F 9/0275; F28F 9/0243; F28F 9/0246; F28F 2265/26; F22B 21/00
See application file for complete search history.

(56) References Cited

U.S. PATENT DOCUMENTS

| | | | | |
|---|---|---|---|---|
| 6,957,630 | B1 | 10/2005 | Mastronarde | |
| 2009/0173072 | A1 * | 7/2009 | Mastronarde | F28F 9/0275 60/659 |
| 2011/0209697 | A1 | 9/2011 | Plotkin | |
| 2011/0239961 | A1 | 10/2011 | Bauver | |
| 2013/0048245 | A1 | 2/2013 | Schroeder | |

FOREIGN PATENT DOCUMENTS

| | | | | | |
|---|---|---|---|---|---|
| CN | 102947637 | A | * | 2/2013 | F28D 7/0041 |
| EP | 2573449 | A1 | | 3/2013 | |
| GB | 1389904 | A | | 4/1975 | |
| JP | H08303704 | A | | 11/1996 | |
| JP | 2007016791 | A | * | 1/2007 | |
| JP | 2009222304 | A | | 10/2009 | |
| JP | 6074073 | B2 | | 2/2017 | |
| JP | 2018028320 | A | | 2/2018 | |
| KR | 1999-0016558 | U | | 5/1999 | |
| KR | 2001-0012356 | A | | 2/2001 | |
| KR | 10-2010-0105759 | A | | 9/2010 | |
| KR | 10-2014-0091465 | A | | 7/2014 | |
| KR | 10-1697816 | B1 | | 1/2017 | |
| KR | 10-2018-0030095 | A | | 3/2018 | |
| KR | 10-1928374 | B1 | | 2/2019 | |
| KR | 10-2019-0067120 | A | | 6/2019 | |
| KR | 10-2266676 | B1 | | 6/2021 | |
| WO | 2011092317 | A2 | | 8/2011 | |

OTHER PUBLICATIONS

Pdf is translation of foreign reference CN-102947637-A (Year: 2013).*
Pdf is translation of foreign reference CH573087A5 (Year: 1976).*
EP EESR, dated Mar. 22, 2024.
Office Action from Korean Patent Office dated 2024-08-21 for a corresponding Korean patent application.

* cited by examiner

ONCE-THROUGH HEAT EXCHANGER AND HEAT RECOVERY STEAM GENERATOR INCLUDING THE SAME

CROSS-REFERENCE TO RELATED APPLICATION

This application claims priority to Korean Patent Application No. 10-2022-0151966, filed on Nov. 14, 2022 the disclosure of which is incorporated herein by reference in its entirety.

BACKGROUND

Technical Field

The present disclosure relates to a once-through heat exchanger and a combined power generation system including the same.

Related Art

A gas turbine is a power engine that mixes air compressed by a compressor with fuel for combustion and rotates a turbine with hot gas produced by the combustion. The gas turbine is used to drive a generator, an aircraft, a ship, a train, etc.

A heat recovery steam generator (HRSG) is an energy recovery device that recovers heat from a hot gas stream to produce steam that is usable to drive a steam turbine (combined cycle). The HRSG typically includes four main components: an economizer, an evaporator, a superheater and a preheater.

In particular, a natural circulation HRSG includes piping to facilitate a proper rate of circulation within an evaporator tube, as well as evaporator heating surfaces and drums. A once-through HRSG includes a once-through evaporator that replaces a natural circulation component, thereby providing higher facility efficiency on site and further assisting in extending HRSG life in the absence of thick wall drums.

In the case of supercritical pressure vertical once-through HRSGs, it is difficult to ensure structural stability due to severe thermal expansion of an outlet head of a final superheater. Heating and thermal expansion of the outlet head by steam heated to a high temperature distorts tube arrangement and concentrates thermal stress, resulting in a high risk of breakage.

SUMMARY

Aspects of one or more exemplary embodiments provide a once-through heat exchanger, a heat recovery steam generator, and a combined power generation system including the same, which are capable of minimizing damage caused by thermal expansion.

Additional aspects will be set forth in part in the description which follows and, in part, will become apparent from the description, or may be learned by practice of the exemplary embodiments.

According to an aspect of an exemplary embodiment, there is provided a once-through heat exchanger that includes a tube stack including a plurality of tubes, a plurality of heads connected to the tube stack via a connection module and configured to accommodate heated steam, the connector module comprising a plurality of tube connectors and configured to connect the tubes and the heads, and a manifold connected to the heads via a plurality of link pipes and configured to accommodate heated steam, and the connector module includes a first tube connector and a second tube connector having different shapes.

The heads may be spaced apart at different distances from the manifold.

The heads adjacent to each other in a longitudinal direction of the manifold may be spaced apart at different distances from the manifold.

The first tube connector may include a first connection part connected to an associated one of the heads, the second tube connector may include a second connection part connected to an associated one of the heads, and the first connection part may have a smaller length than the second connection part.

The first connection part and the second connection part may be formed in parallel.

The first tube connector may further include a first extension part extending in a longitudinal direction of the link pipes from the first connection part, a first intermediate part extending in a longitudinal direction of the first connection part from the first extension part, and a first tip part extending in a longitudinal direction of the first extension part from the first intermediate part.

The second tube connector may further include a second tip part extending in the longitudinal direction of the link pipes from the second connection part.

The connector module may further include a third tube connector having a different shape from the first and second tube connectors, the third tube connector may include a third connection part connected to associated ones of the heads, and the third connection part may have a larger length than the second connection part.

The third tube connector may further include a third extension part extending in the longitudinal direction of the link pipes from the third connection part, an inclined part extending obliquely from the third extension part, and a third tip part extending in a longitudinal direction of the third extension part from the inclined part.

According to an aspect of another exemplary embodiment, there is provided a combined power generation system that includes a gas turbine configured to generate rotational force by combusting fuel and discharge combustion gas, a heat recovery steam generator configured to generate and heat steam using the combustion gas discharged from the gas turbine, and a steam turbine using the steam heated by the heat recovery steam generator. The heat recovery steam generator includes a plurality of heat exchangers. Each of the heat exchangers includes a tube stack including a plurality of tubes, a plurality of heads connected to the tube stack via a connection module and configured to accommodate the heated steam, the connector module comprising a plurality of tube connectors and configured to connect the tubes and the heads, a manifold connected to the heads via a plurality of link pipes and configured to accommodate heated steam, and the connector module includes a first tube connector and a second tube connector having different shapes.

The heads may be spaced apart at different distances from the manifold.

The heads adjacent to each other in a longitudinal direction of the manifold may be spaced apart at different distances from the manifold.

The first tube connector may include a first connection part connected to an associated one of the heads, the second tube connector may include a second connection part connected to an associated one of the heads, and the first connection part may have a smaller length than the second connection part.

The first connection part and the second connection part may be formed in parallel.

The first tube connector may further include a first extension part extending in a longitudinal direction of the link pipes from the first connection part, a first intermediate part extending in a longitudinal direction of the first connection part from the first extension part, and a first tip part extending in a longitudinal direction of the first extension part from the first intermediate part.

The second tube connector may further include a second tip part extending in the longitudinal direction of the link pipes from the second connection part.

The connector module may further include a third tube connector having a different shape from the first and second tube connectors, the third tube connector may include a third connection part connected to associated ones of the heads, and the third connection part may have a larger length than the second connection part.

The third tube connector may further include a third extension part extending in the longitudinal direction of the link pipes from the third connection part, an inclined part extending obliquely from the third extension part, and a third tip part extending in a longitudinal direction of the third extension part from the inclined part.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
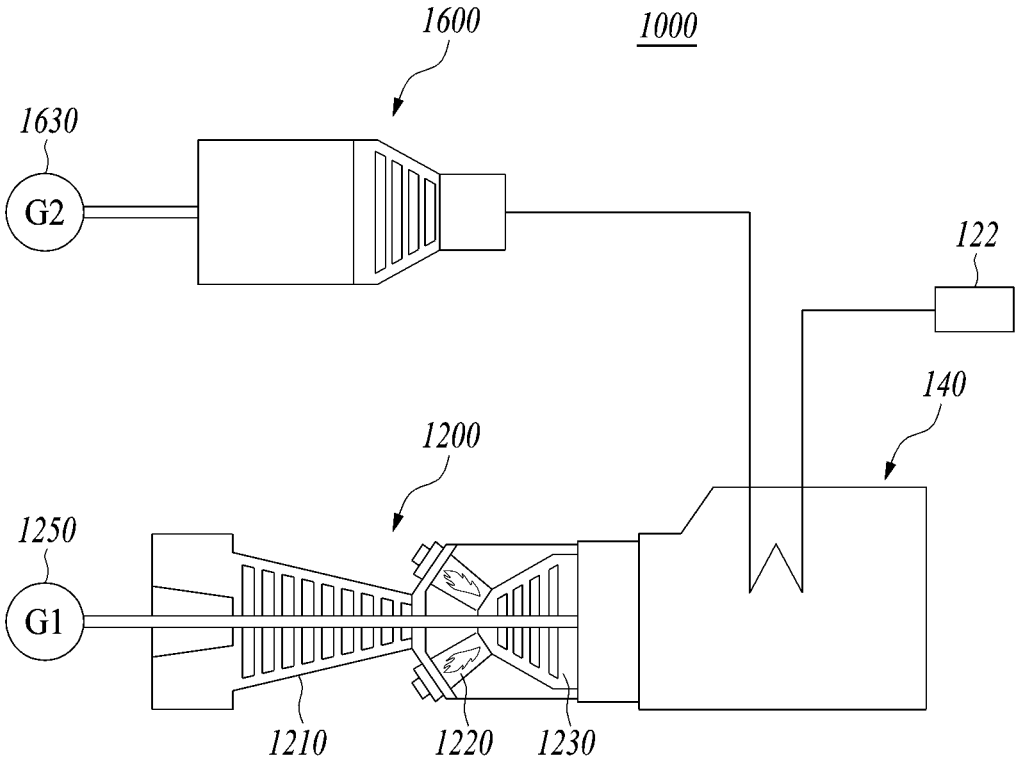
FIG. 1 is a configuration diagram illustrating a combined power generation system according to a first exemplary embodiment.

Various modifications and different embodiments will be described below in detail with reference to the accompanying drawings so that those skilled in the art can easily carry out the disclosure. It should be understood, however, that the present disclosure is not intended to be limited to the specific embodiments, but the present disclosure includes all modifications, equivalents or replacements that fall within the spirit and scope of the disclosure as defined in the following claims.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout various drawings and exemplary embodiments. In certain embodiments, a detailed description of functions and configurations well known in the art may be omitted to avoid obscuring appreciation of the disclosure by those skilled in the art. For the same reason, some components may be exaggerated, omitted, or schematically illustrated in the accompanying drawings.

Hereinafter, a combined power generation system according to a first exemplary embodiment will be described.

Figure 2:
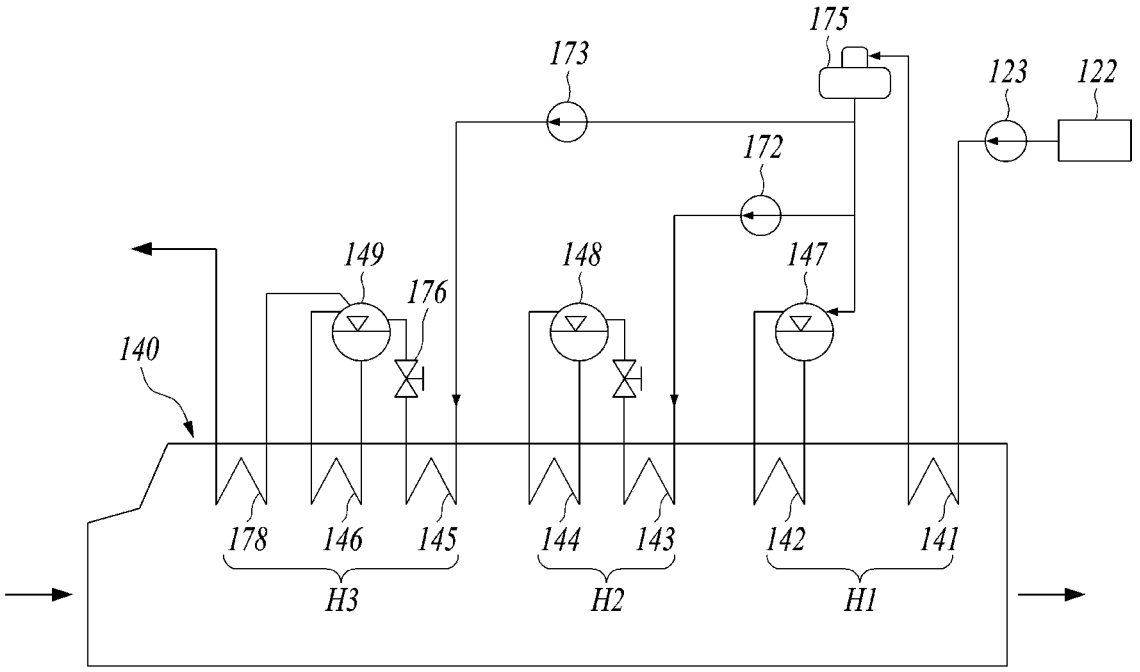
FIG. 2 is a configuration diagram illustrating a heat recovery steam generator according to the first exemplary embodiment.

FIG. 1 is a schematic configuration diagram illustrating the combined power generation system according to the first exemplary embodiment. FIG. 2 is a schematic configuration diagram illustrating a heat recovery steam generator according to the first exemplary embodiment.

Referring to FIGS. 1 and 2, the combined power generation system, which is designated by reference numeral 1000, according to the first exemplary embodiment, may include a gas turbine 1200, a steam turbine 1600, a first generator G1, a second generator G2, and a heat recovery steam generator 140.

In the gas turbine 1200, in an isobaric environment, thermal energy may be released through combustion of fuel. This combustion takes place after atmospheric air is sucked and compressed to a high pressure. The hot combustion gas resulting from this process is then allowed to expand, converting its energy into kinetic energy. Finally, the exhaust gas, which still contains residual energy, is discharged to the atmosphere.

The gas turbine 1200 may include a compressor 1210, a combustor 1220, and a main turbine 1230. The compressor 1210 of the gas turbine 1200 may suck air from the outside and compress the air. The compressor 1210 may supply the combustor 1220 with the air compressed by compressor blades and may also supply cooling air to a hot region required for cooling in the gas turbine 1200.

Meanwhile, the combustor 1220 may mix the compressed air, which is supplied from the outlet of the compressor 1210, with fuel for isobaric combustion to produce combustion gas with high energy.

The high-temperature and high-pressure combustion gas produced by the combustor 1220 is supplied to the main turbine 1230. In the main turbine 1230, the combustion gas applies impingement or reaction force to a plurality of turbine blades radially disposed on the rotary shaft of the main turbine 1230 while expanding adiabatically, so that the thermal energy of the combustion gas is converted into mechanical energy for rotating the rotary shaft. Some of the mechanical energy obtained from the main turbine 1230 is used to drive the compressor 1210 to compress the air. The remaining mechanical energy is utilized as effective energy to drive the first generator G1 to generate electric power.

The heat recovery steam generator 140 produces high-temperature and high-pressure steam using the heat of the combustion gas discharged from the gas turbine 1200 and delivers the steam to the steam turbine 1600. During the process, the combustion gas is cooled. After the combustion gas flowing out of the main turbine 1230 is cooled through the heat recovery steam generator 140, it is purified and discharged to the outside.

The steam turbine 1600 rotates the blades thereof using the steam produced by the heat recovery steam generator 140 and transfers rotational energy to the second generator G2. The steam turbine 1600 supplies cooled steam back to the heat recovery steam generator 140.

The first generator G1 may be connected to the gas turbine 1200 and the second generator G2 may be connected to the steam turbine 1600 so as to generate electric power. However, the present disclosure is not limited thereto, and a single generator, instead of the first generator G1 and the second generator G2, may be connected to the gas turbine 1200 and the steam turbine 1600.

The combined power generation system may be equipped with a condenser 121 for condensing steam, a condensate reservoir 122 for storing condensed water, and a condensate pump 123 for supplying the heat recovery steam generator 140 with the condensed water stored in the condensate reservoir 122.

The steam flowing in the heat recovery steam generator 140 may have two or three levels of pressure, so that the water is pressurized to two or three or more levels of pressure. In the exemplary embodiment, the heat recovery steam generator 140 is exemplified as having three levels of pressure as shown in FIG. 2.

Referring to FIG. 2, the heat recovery steam generator 140 may include a low-pressure section H1 having a relatively low pressure, a medium-pressure section H2 having a medium pressure, and a high-pressure section H3 having a relatively high pressure. The high-pressure section H3 may be disposed adjacent to an inlet of the heat recovery steam generator 140 for introduction of combustion gas therethrough, where it gets heated by high-temperature combustion gas. The low-pressure section H1 may be disposed adjacent to an outlet of the heat recovery steam generator 140 for discharge of combustion gas therethrough, where it gets heated by low-temperature combustion gas.

The heat recovery steam generator 140 includes a condensate preheater 141, a low-pressure evaporator 142, a medium-pressure economizer 143, a medium-pressure evaporator 144, a high-pressure economizer 145, and a high-pressure evaporator 146, which are installed therein. In addition, a superheater (not shown) may be installed for each evaporator 142, 144, 146. The combustion gas flowing out of the heat recovery steam generator 140 may be discharged via a stack.

The low-pressure section H1 includes a condensate preheater 141, a low-pressure evaporator 142, and a low-pressure drum 147. The condensed water stored in the condensate reservoir 122 is delivered to the condensate preheater 141 by the condensate pump 123. The condensate preheater 141 heats the condensed water by exchanging heat with combustion gas. The water heated by the condensate preheater 141 is delivered to a deaerator 175 so that gas is removed from the condensed water.

Then, water is supplied from the deaerator 175 to the low-pressure drum 147. The low-pressure evaporator 142 may be connected to the low-pressure drum 147, so that the water stored in the low-pressure drum 147 is converted into steam by exchanging heat with combustion gas. Then, the steam is supplied to the low-pressure superheater (not shown) after steam-water separation is performed in the low-pressure drum 147.

The medium-pressure section H2 includes a medium-pressure economizer 143, a medium-pressure evaporator 144, and a medium-pressure drum 148. The water in the deaerator 175 is supplied to the medium-pressure economizer 143 by a medium-pressure pump 172. The medium-pressure economizer 143 heats the water by exchanging heat with combustion gas. The water heated in the medium-pressure economizer 143 is supplied to the medium-pressure drum 148. The medium-pressure evaporator 144 may be connected to the medium-pressure drum 148, so that the water stored in the medium-pressure drum 148 is converted into steam by exchanging heat with combustion gas and the steam is then supplied to the medium-pressure superheater (not shown) after steam-water separation is performed in the medium-pressure drum 148.

The high-pressure section H3 includes a high-pressure economizer 145, a high-pressure evaporator 146, a high-pressure drum 149, and a high-pressure superheater 178. The water in the deaerator 175 is supplied to the high-pressure economizer 145 by a high-pressure pump 173. The high-pressure economizer 145 heats the water by exchanging heat with combustion gas. The water heated in the high-pressure economizer 145 is supplied to the high-pressure drum 149. The high-pressure evaporator 146 may be connected to the high-pressure drum 149, so that the water stored in the high-pressure drum 149 is converted into steam by exchanging heat with combustion gas and the steam is then supplied to the high-pressure superheater 178 after steam-water separation in the high-pressure drum 149.

The steam stored in the low-pressure drum 147, the medium-pressure drum 148, and the high-pressure drum 149 may be supplied to low-pressure, medium-pressure, and high-pressure steam turbines, respectively. During such supply, the steam stored in the low-pressure drum 147, the steam stored in the medium-pressure drum 148, and the steam stored in the high-pressure drum 149 may be supplied through the low-pressure superheater (not shown), the medium-pressure superheater (not shown), and the high-pressure superheater 178, respectively.

Figure 3:
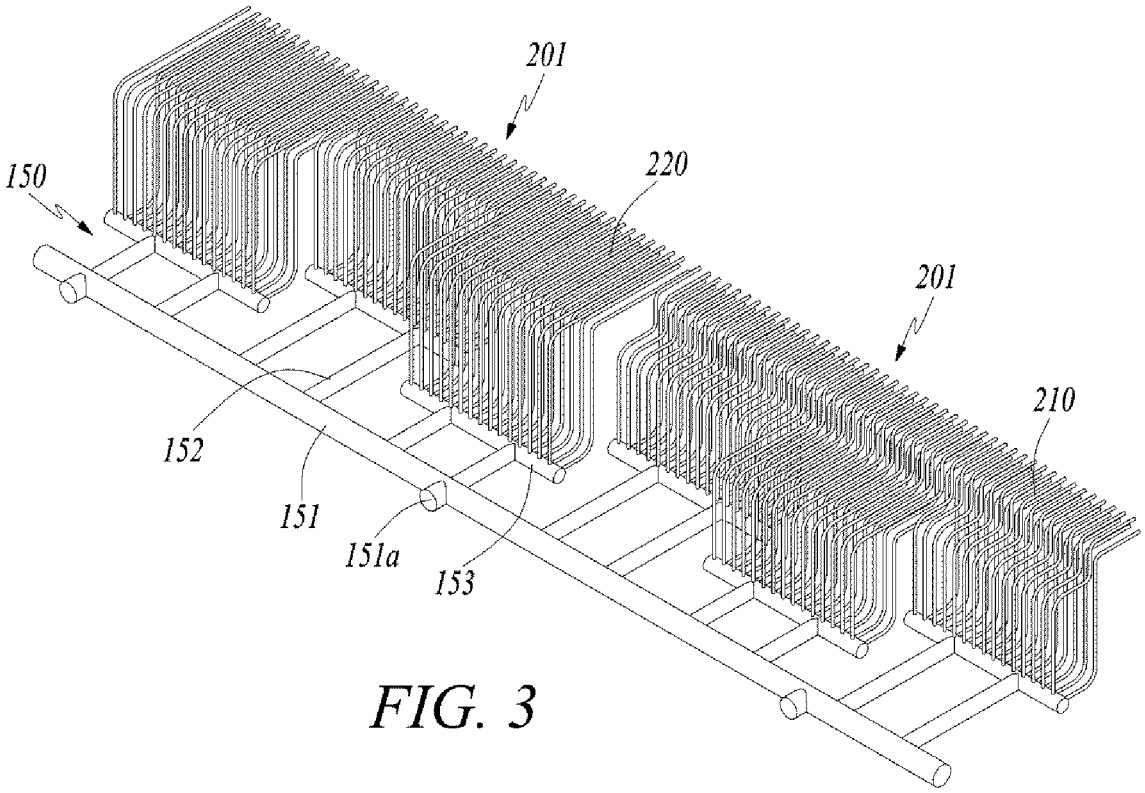
FIG. 3 is a perspective view illustrating a heat exchanger according to the first exemplary embodiment.
Figure 4:
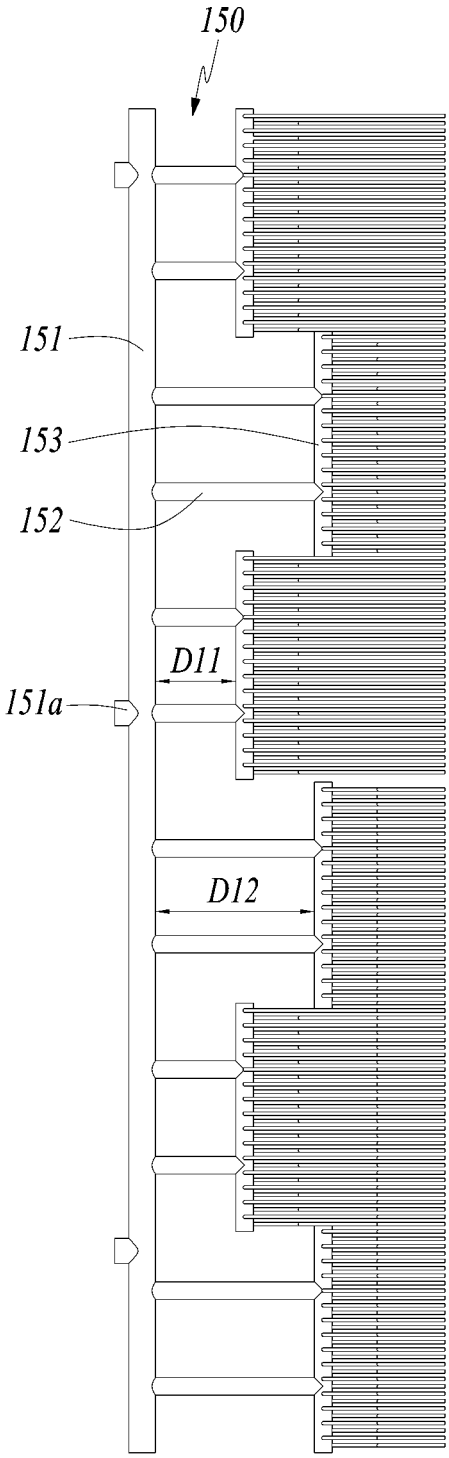
FIG. 4 is a top view illustrating the heat exchanger according to the first exemplary embodiment.
Figure 5:
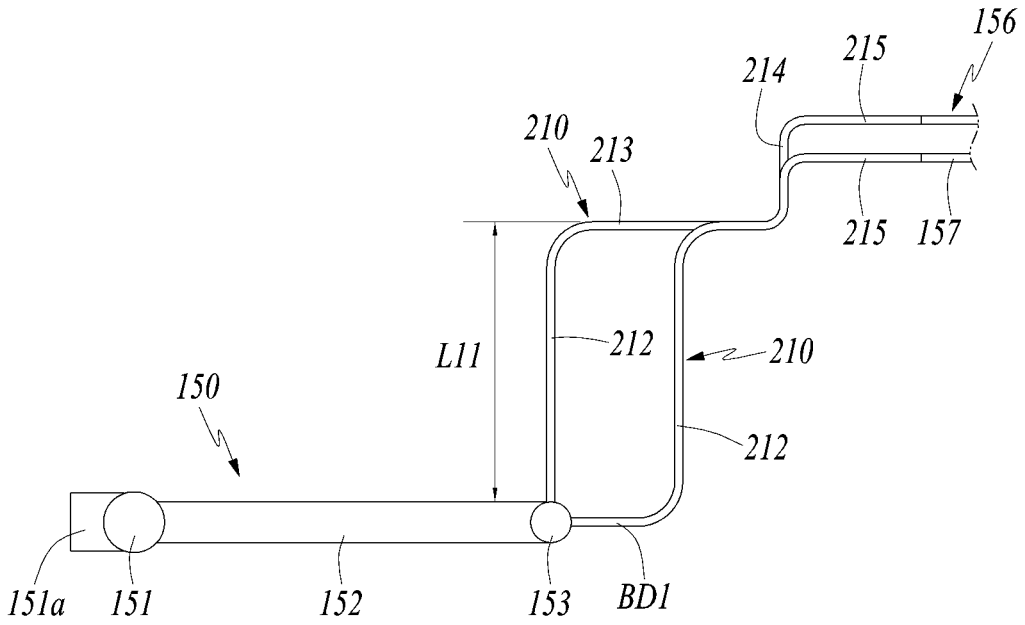
FIG. 5 is a side view illustrating a first tube connector according to the first exemplary embodiment.
Figure 6:
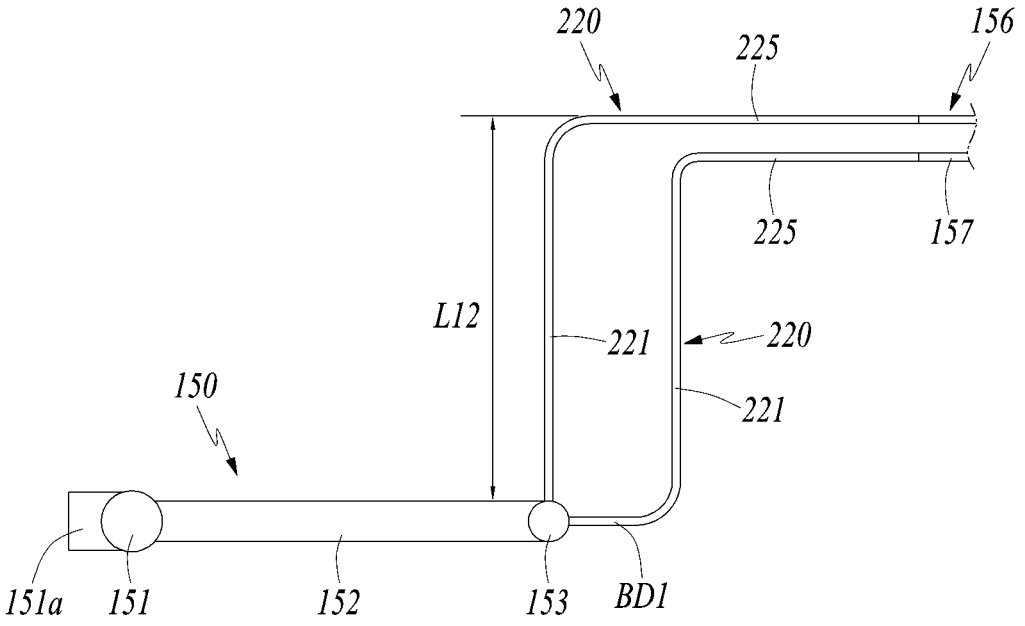
FIG. 6 is a side view illustrating a second tube connector according to the first exemplary embodiment.

FIG. 3 is a perspective view illustrating a heat exchanger according to the first exemplary embodiment. FIG. 4 is a top view illustrating the heat exchanger according to the first exemplary embodiment. FIG. 5 is a side view illustrating a first tube connector according to the first exemplary embodiment. FIG. 6 is a side view illustrating a second tube connector according to the first exemplary embodiment. Throughout the specification, the direction of the side view is the direction parallel to the longitudinal direction of the manifold 151, which will be described later.

Referring to FIGS. 3 to 6, the heat exchanger, which is designated by reference numeral 150, according to the present embodiment may be a once-through heat exchanger, and in particular, a vertical once-through heat exchanger applied to the heat recovery steam generator 140. Alternatively, the heat exchanger 150 may be the high-pressure superheater 178 of the high-pressure section H3.

The heat exchanger 150 may include a tube stack 156, a connector module 201, a plurality of heads 153, a plurality of link pipes 152, and a manifold 151. The tube stack 156 includes a plurality of tubes 157 and serves to overheat steam by exchanging heat with the combustion gas. The tubes 157 may be connected in a straight line, and the steam flowing along the tube stack 156 may be heated by the high-temperature combustion gas.

The connector module 201 includes a plurality of first tube connectors 210 and a plurality of second tube connectors 220 and connect the tubes 157 and the heads 153 via the plurality of first and second tube connectors 210 and 220. The first and second tube connectors 210 and 220 may be composed of pipes, each having a passage through which steam flows, and may each have at least one curved structure. The first and second tube connectors 210 and 220 may have a greater thickness than tubes 157.

The heads 153 are connected to the connector module 201 and accommodate steam delivered from the connector module 201. Each of the heads 153 may be connected to a plurality of tube connectors 210 and/or 220. Each of the heads 153 may be a pipe that extends parallel to the manifold 151 and has both longitudinal ends blocked.

The heads 153 may be arranged in the longitudinal direction thereof and spaced at different distances from the manifold 151. That is, one head 153 may be spaced apart from the manifold 151 by a first distance D11, and another head 153 may be spaced apart from the manifold 151 by a second distance D12 greater than the first distance D11. In particular, two heads 153 adjacent to each other in the longitudinal direction of the manifold 151 are spaced apart at different distances from the manifold 151.

The link pipes 152 may connect the heads 153 and the manifold 151. The link pipes 152 may be disposed to be perpendicular to the heads 153 and the manifold 151. In addition, the manifold 151 and any one of the heads 153 may be connected by two link pipes 152. The link pipes 152 may each have a thickness greater than that of the connector module 201.

The manifold 151 may be a long pipe, and the heads are connected to the manifold through the link pipes 152. The manifold 151 may have a plurality of connection pipes 151*a* formed for introduction or discharge of steam.

Meanwhile, the connector module 201 may include a plurality first tube connectors 210 and a plurality of second tube connectors 220 having different shapes from the first tube connectors 210. According to an embodiment, all of the heads 153 may be connected to both the first tube connectors 210 and the second tube connectors 220. However, according to another embodiment, one head 153 may be connected to both the first tube connectors 210 and the second tube connectors 220 while another head 153 may be connected to only the first tube connectors 210 or to only the second tube connectors 220.

The first tube connector 210 may include a first connection part 212, a first extension part 213, a first intermediate part 214, and a first tip part 215, connected sequentially from an associated one of the heads 153. The first connection part 212 is disposed perpendicular to and connected to an associated head 153. The first connection part 212 may be also perpendicular to the link pipe 152. The first extension part 213 extends in the longitudinal direction of the link pipes 152 from the first connection part 212. The first intermediate part 214 extends in the longitudinal direction of the first connection part 212 from the first extension part 213. The first tip part 215 extends in the longitudinal direction of the first extension part 213 from the first intermediate part 214. The first tip part 215 is connected to an associated one of the tubes 157.

Meanwhile, the first tube connector 210 may further include a bent part BD1 connected to the side end of the associated head 153, and the first connection part 212 may be connected to the associated head 153 via the bent part BD1. The bent part BD1 may include a straight portion and a bent portion. The straight portion of the bent part BD1 may be connected to the associated head 153 and extended in a direction parallel to the link pipe 152. The first connection part 212 may be connected to straight portion of the bent part BD1 via the bent portion.

The first connection part 212 connected to the associated head 153 without the bent part BD1 and the first connection part 212 connected to the same head 153 via the bent part BD1 are parallel to each other and spaced apart from each other in the longitudinal direction of the link pipe 152.

The first extension part 213 of the first tube connector 210 connected to the associated head 153 without the bent part BD1 and the first extension part 213 of the first connector 210 connected to the same head 153 via the bent part BD1 may have different length. Similarly, the first intermediate part 214 of the first tube connector 210 connected to the associated head 153 without the bent part BD1 and the first intermediate part 214 of the first connector 210 connected to the same head 153 via the bent part BD1 may have different length. As such, the first extension part 213 and the first intermediate part 214 of the first tube connector 210 connected to the associated head 153 without the bent part BD1 and the first extension part 213 and the first intermediate part 214 of the first connector 210 connected to the same head 153 via the bent part BD1 may be partially overlapped, respectively, when viewed in a side view of the heat exchanger 150.

Also, the first tip part 215 of the first tube connector 210 connected to the associated head 153 without the bent part BD1 and the first tip part 215 of the first connector 210 connected to the same head 153 via the bent part BD1 may be parallel to each other and spaced apart from each other in the longitudinal direction of the first connection part 212.

The second tube connector 220 may include a first connection part 221 and a second tip part 225. The second connection part 221 is disposed perpendicular to and connected to an associated head 153. The second connection part 221 may also be perpendicular to the link pipe 152. The second tip part 225 extends in the longitudinal direction of the link pipes 152 from the second connection part 221. The second tip part 225 is connected to an associated one of the tubes 157. Meanwhile, the second tube connector 220 may further include a bent part BD1 connected to the side end of the associated head 153, and the second connection part 221 may be connected to the associated head 153 via the bent part BD1.

Here, the first connection part 212 and the second connection part 221 may be formed in parallel, and the length L11 of the first connection part 212 may be smaller than the length L12 of the second connection part 221.

The second connection part 221 connected to the associated head 153 without the bent part BD1 and the second connection part 221 connected to the same head 153 via the bent part BD1 may be parallel to each other and spaced apart from each other in the longitudinal direction of the link pipe 152. Also, the second connection part 221 connected to the associated head 153 without the bent part BD1 and the second connection part 221 connected to the same head 153 via the bent part BD1 may have different length such that the second tip parts 225 connected to them, respectively, are spaced apart in the longitudinal direction of the second connection part 221.

As in the first exemplary embodiment, if two adjacent heads 153 are spaced at different distances from the manifold 151, it is possible and it is provided with a space to absorb a certain amount of deformation when the tubes 157, the heads 153, and the manifold 151 are deformed by steam. In addition, if the first and second tube connectors 210 and 220 have different shapes and the first connection part 212 has a smaller length than the second connection part 221, it is possible to minimize deformation of the arrangement of the tubes 157 caused by thermal deformation or damage to the piping caused by thermal stress.

Hereinafter, a heat exchanger according to a second exemplary embodiment will be described.

Figure 7:
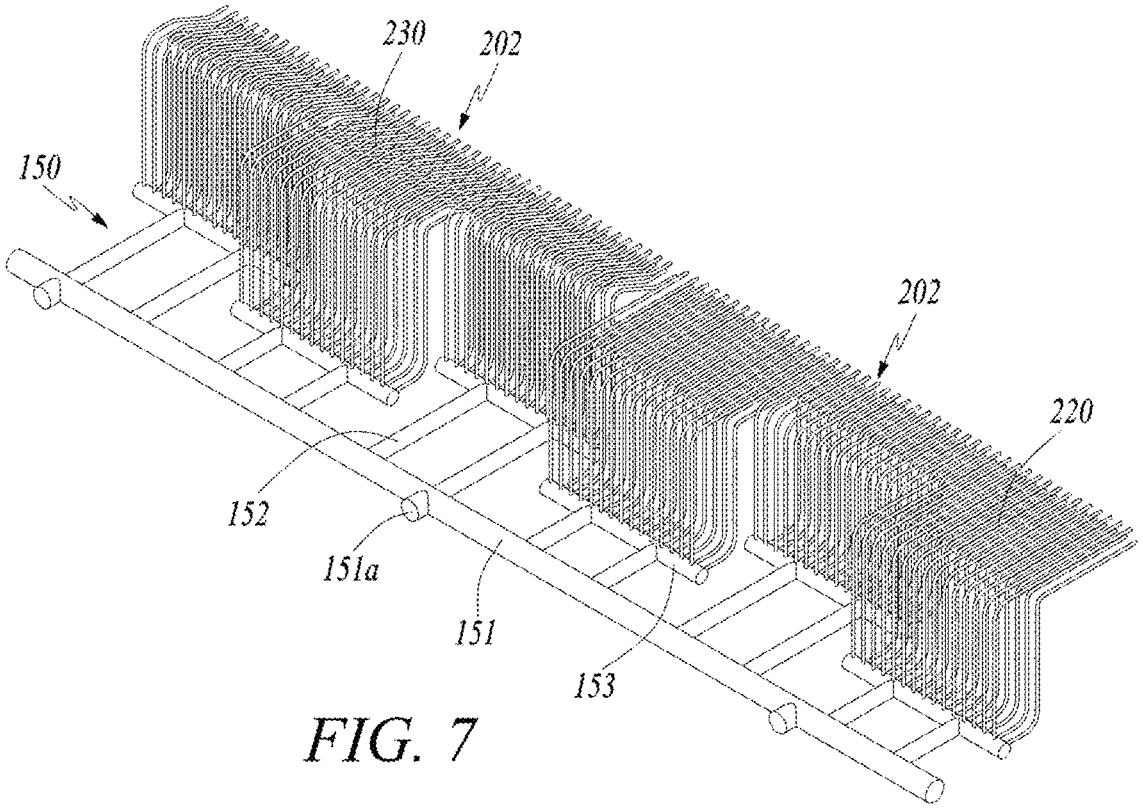
FIG. 7 is a perspective view illustrating a heat exchanger according to a second exemplary embodiment.
Figure 8:
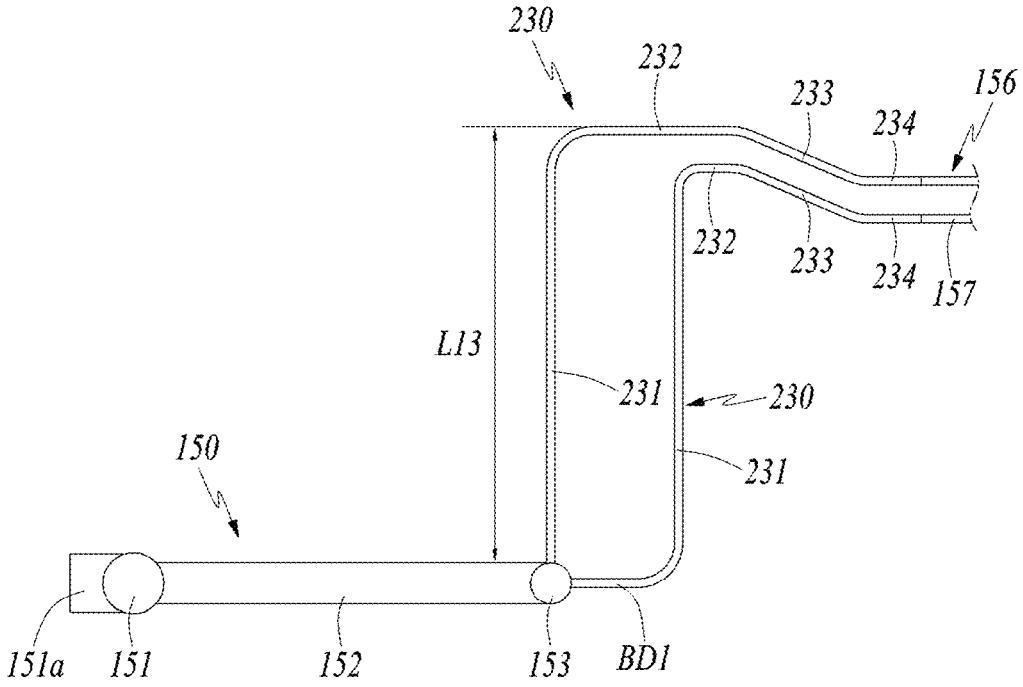
FIG. 8 is a side view illustrating a third tube connector according to the second exemplary embodiment.

FIG. 7 is a perspective view illustrating the heat exchanger according to the second exemplary embodiment. FIG. 8 is a side view illustrating a third tube connector according to the second exemplary embodiment.

Referring to FIGS. 7 and 8, the heat exchanger, which is designated by reference numeral 150, according to the second exemplary embodiment, may include a tube stack 156, a connector module 202, a plurality of heads 153, a plurality of link pipes 152, and a manifold 151.

Since the heat exchanger 150 according to the second exemplary embodiment has the same structure as the heat exchanger according to the first exemplary embodiment, with the sole exception of the connector module 202, a redundant description thereof will be omitted.

The connector module 202 may include a third tube connector 230. The third tube connector 230 may have a different shape from the first tube connector 210 and the second tube connector 220. The connector module 202 may include the third tube connector 230 together with the first tube connector 210 or the second tube connector 220. When the connector module 202 includes the first tube connector 210 or the second tube connector 220 together with the third tube connector 230, the first tube connector 210 or the second tube connector 220 may be connected to different heads from the third tube connector 230.

The third tube connector 230 may include a third connection part 231, a third extension part 232, an inclined part 233, and a third tip part 234. The third connection part 231 is connected to an associated one of the heads 153. The third extension part 232 extends from the third connection part 231 in the longitudinal direction of and in parallel to the link pipes 152. The inclined part 233, while being straight, is connected to and extending obliquely from the third extension part 232, inclined toward the associated head 153. The third tip part 234 extends from the inclined part 233 in the longitudinal direction of the third extension part 232. The third tip part 234 is connected to an associated one of the tubes 157.

Meanwhile, the third tube connector 230 may further include a bent part BD1 connected to the side end of the associated head 153, and the third connection part 231 may be connected to the associated heads via the bent part BD1.

Here, when the connector module 202 includes the second tube connector 220 together with the third tube connector 230, the third connection part 231 and the second connection part 221 may be formed in parallel, and the length L13 of the third connection part 231 may be larger than the length L12 of the second connection part 221.

As in the second exemplary embodiment, if the connector module 202 includes the third tube connectors 220 which have different shapes from the first and second connection part 212, 221 as described above, it is possible to reliably prevent the tubes 157 from being broken due to thermal deformation.

Hereinafter, a heat exchanger according to a third exemplary embodiment will be described.

Figure 9:
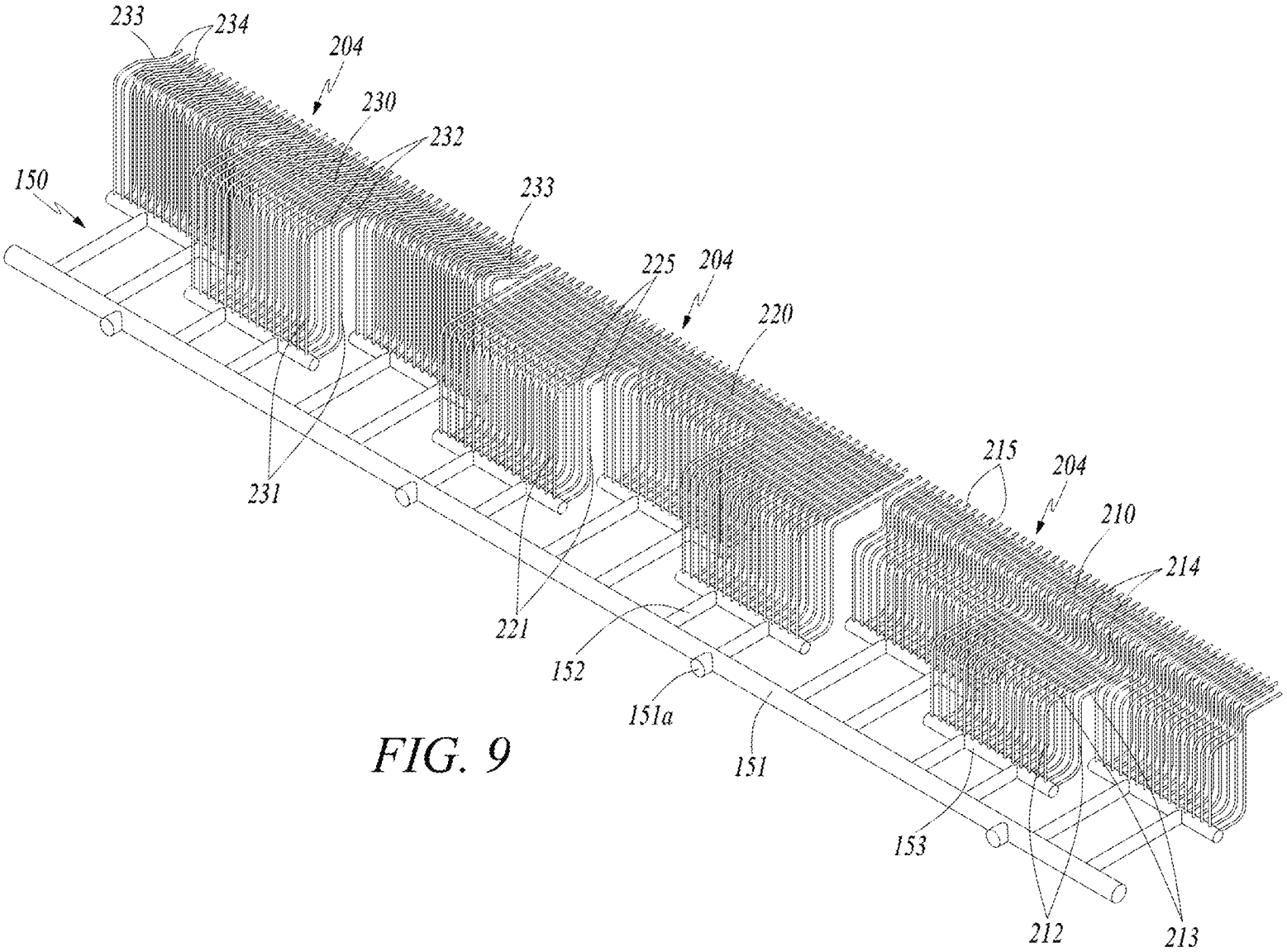
FIG. 9 is a perspective view illustrating a heat exchanger according to a third exemplary embodiment.

FIG. 9 is a perspective view illustrating the heat exchanger according to the third exemplary embodiment.

Referring to FIG. 9, the heat exchanger, which is designated by reference numeral 150, according to the third exemplary embodiment may include a tube stack 156, a connector module 204, a plurality of heads 153, a plurality of link pipes 152, and a manifold 151.

Since the heat exchanger 150 according to the third exemplary embodiment has the same structure as the heat exchanger according to the first exemplary embodiment, with the sole exception of the connector module 204, a redundant description thereof will be omitted.

The connector module 204 connects the tubes 157 and the heads 153 and includes a plurality of tube connectors 210, 220, and 230. In addition, the connector module 204 may include a first tube connector 210, a second tube connector 220, and a third tube connector 230 having different shapes. The first tube connector 210 and the second tube connector 220 may be connected to the same head or different heads 153. Meanwhile, the third tube connector 230 may be connected to heads 153 different from those connected to the first and second tube connectors 210 and 220.

The first and second tube connectors 210 and 220 according to the third exemplary embodiment may have the same structure as the first and second tube connectors 210 and 220 of the above-mentioned first exemplary embodiment. The third tube connector 230 according to the third exemplary embodiment may have the same structure as the third tube connector 230 of the second exemplary embodiment.

As in the third exemplary embodiment, if the first, second, and third tube connectors 210, 220, and 230 have different shapes, the first connection part 212 has a smaller length than the second connection part 221, and the second connection part 221 has a smaller length than the third connection part 231, it is possible to reliably prevent the tubes from being broken due to thermal deformation.

Hereinafter, a heat exchanger according to a fourth exemplary embodiment will be described.

Figure 10:
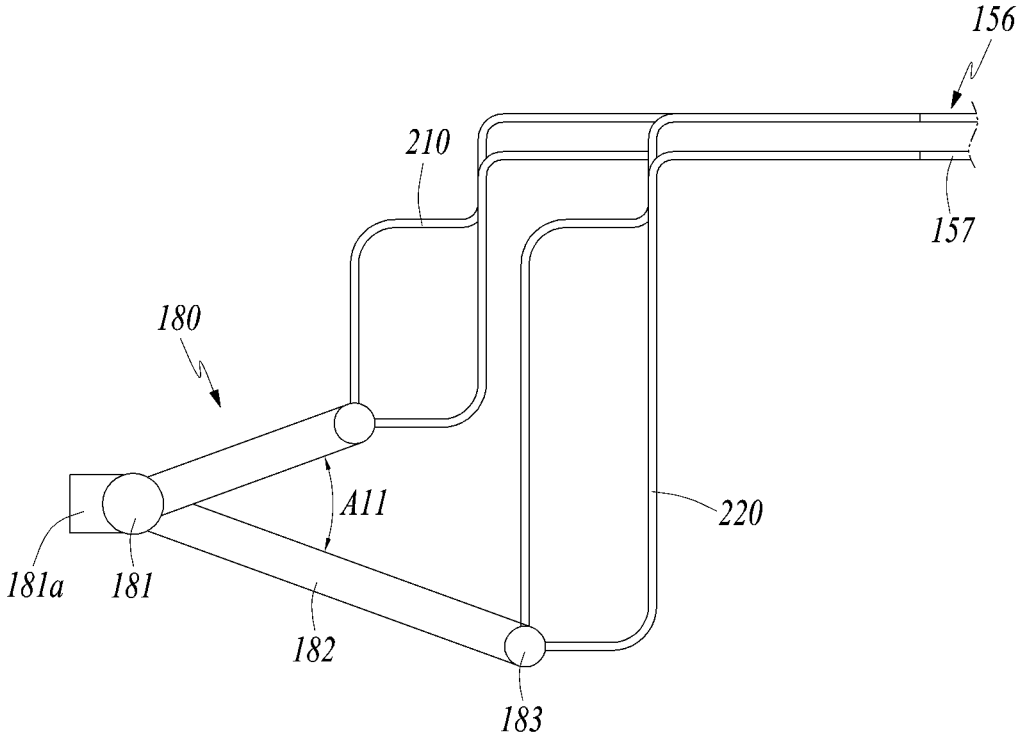
FIG. 10 is a perspective view illustrating a heat exchanger according to a fourth exemplary embodiment.

FIG. 10 is a perspective view illustrating the heat exchanger according to the fourth exemplary embodiment.

Referring to FIG. 10, the heat exchanger, which is designated by reference numeral 180, according to the fourth exemplary embodiment may include a tube stack 156, a connector module, a plurality of heads 183, a plurality of link pipes 182, and a manifold 181. The manifold 181 may be a long pipe, and may have a plurality of connection pipes 181*a* formed for introduction or discharge of steam.

Since the heat exchanger 180 according to the fourth exemplary embodiment has the same structure as the heat exchanger according to the first exemplary embodiment, with the sole exception of the link pipes 182, a redundant description thereof will be omitted.

The link pipes 182 may connect the heads 183 and the manifold 181. In addition, the manifold 181 and any one of the heads 183 may be connected by two link pipes 182. The connector module may include a first tube connector 210 and a second tube connector 220, but the present disclosure is not limited thereto.

The link pipes coupled to different heads are formed to have different lengths, and the link pipes having different lengths are arranged obliquely to each other. Some of the link pipes may be inclined upward, while some of the link pipes may be inclined downward in the longitudinal direction of the first connecting part 212.

As in the fourth exemplary embodiment, if the link pipes have different lengths and the link pipes 182 are inclined to each other, it is possible to reliably prevent the tubes from being broken due to thermal deformation.

As is apparent from the above description, the once-through heat exchanger according to the exemplary embodiments can prevent breakage and stress concentration due to thermal deformation since the heads are spaced at different distances from the manifold and the heads and the manifold are connected via the link pipes.

In addition, since the tube connectors constituting the connector module have different shapes, it is possible to minimize deformation of the arrangement of the tubes caused by thermal deformation or damage to the piping caused by thermal stress.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims. Also, it is noted that any one feature of an embodiment of the present disclosure described in the specification may be applied to another embodiment of the present disclosure.

What is claimed is:

1. A once-through heat exchanger comprising:

a tube stack comprising a plurality of tubes;

a plurality of heads connected to the tube stack via a connection module and configured to accommodate heated steam;

the connector module comprising a plurality of tube connectors and configured to connect the tubes and the heads; and a manifold connected to the heads via a plurality of link pipes and configured to accommodate heated steam;

wherein the connector module comprises a first tube connector and a second tube connector having different shapes, wherein each of the heads is a pipe that extends parallel to the manifold and has both longitudinal ends blocked, and wherein the heads are spaced at different distances from the manifold, wherein the heads adjacent to each other in a longitudinal direction of the manifold are spaced apart at different distances from the manifold, wherein the first tube connector comprises a first connection part connected to an associated one of the heads, and the second tube connector comprises a second connection part connected to an associated one of the heads, and the first connection part has a smaller length than the second connection part, wherein the first tube connector further comprises a first extension part extending in a longitudinal direction of the link pipes from the first connection part, a first intermediate part extending in a longitudinal direction of the first connection part from the first extension part, and a first tip part extending in a longitudinal direction of the first extension part from the first intermediate part.

2. The once-through heat exchanger according to claim 1, wherein the first connection part and the second connection part are formed in parallel.

3. The once-through heat exchanger according to claim 1, wherein the second tube connector further comprises a second tip part extending in the longitudinal direction of the link pipes from the second connection part.

4. The once-through heat exchanger according to claim 3, wherein:

the connector module further comprises a third tube connector having a different shape from the first and second tube connectors; and the third tube connector comprises a third connection part connected to associated ones of the heads, and the third connection part has a larger length than the second connection part.

5. The once-through heat exchanger according to claim 4, wherein the third tube connector further comprises a third extension part extending in the longitudinal direction of the link pipes from the third connection part, an inclined part extending obliquely from the third extension part, and a third tip part extending in a longitudinal direction of the third extension part from the inclined part.

6. A combined power generation system comprising:

a gas turbine configured to generate rotational force by combusting fuel and discharge combustion gas;

a heat recovery steam generator configured to generate and heat steam using the combustion gas discharged from the gas turbine; and a steam turbine using the steam heated by the heat recovery steam generator, wherein the heat recovery steam generator comprises a plurality of heat exchangers, wherein each of the heat exchangers comprises:

a tube stack comprising a plurality of tubes;

a plurality of heads connected to the tube stack via a connection module and configured to accommodate the heated steam;

the connector module comprising a plurality of tube connectors and configured to connect the tubes and the heads; and a manifold connected to the heads via a plurality of link pipes and configured to accommodate heated steam;

wherein the connector module comprises a first tube connector and a second tube connector having different shapes, wherein each of the heads is a pipe that extends parallel to the manifold and has both longitudinal ends blocked, and wherein the heads are spaced at different distances from the manifold, wherein the heads adjacent to each other in a longitudinal direction of the manifold are spaced apart at different distances from the manifold, wherein the first tube connector comprises a first connection part connected to an associated one of the heads, and the second tube connector comprises a second connection part connected to an associated one of the heads, and the first connection part has a smaller length than the second connection part, wherein the first tube connector further comprises a first extension part extending in a longitudinal direction of the link pipes from the first connection part, a first intermediate part extending in a longitudinal direction of the first connection part from the first extension part, and a first tip part extending in a longitudinal direction of the first extension part from the first intermediate part.

7. The combined power generation system according to claim 6, wherein the first connection part and the second connection part are formed in parallel.

8. The combined power generation system according to claim 6, wherein the second tube connector further comprises a second tip part extending in the longitudinal direction of the link pipes from the second connection part.

9. The combined power generation system according to claim 8, wherein:

the connector module further comprises a third tube connector having a different shape from the first and second tube connectors; and the third tube connector comprises a third connection part connected to associated ones of the heads, and the third connection part has a larger length than the second connection part.

10. The combined power generation system according to claim 9, wherein the third tube connector further comprises a third extension part extending in the longitudinal direction of the link pipes from the third connection part, an inclined part extending obliquely from the third extension part, and a third tip part extending in a longitudinal direction of the third extension part from the inclined part.

* * * * *